US010995715B2

(12) United States Patent
Legrand et al.

(10) Patent No.: US 10,995,715 B2
(45) Date of Patent: May 4, 2021

(54) COIL ASSEMBLY

(71) Applicant: DELPHI TECHNOLOGIES IP LIMITED, St. Michael (BB)

(72) Inventors: Philippe Legrand, Saint-Gervais-la-Forêt (FR); Bruno Bimbenet, Saint-Claude-de-Diray (FR); Stéphanie Lefevre, Molineuf (FR)

(73) Assignee: DELPHI TECHNOLOGIES IP LIMITED

( * ) Notice: Subject to any disclaimer, the term of this patent is extended or adjusted under 35 U.S.C. 154(b) by 14 days.

(21) Appl. No.: 16/329,889

(22) PCT Filed: Aug. 21, 2017

(86) PCT No.: PCT/EP2017/071046
§ 371 (c)(1),
(2) Date: Mar. 1, 2019

(87) PCT Pub. No.: WO2018/041656
PCT Pub. Date: Mar. 8, 2018

(65) Prior Publication Data

US 2019/0242344 A1 Aug. 8, 2019

(30) Foreign Application Priority Data

Sep. 1, 2016 (FR) ..... 1658148

(51) Int. Cl.
*F02M 47/02* (2006.01)
*F02M 55/00* (2006.01)
*F02M 63/00* (2006.01)

(52) U.S. Cl.
CPC ..... *F02M 47/027* (2013.01); *F02M 55/002* (2013.01); *F02M 55/007* (2013.01);
(Continued)

(58) Field of Classification Search
CPC .. F02M 47/027; F02M 55/002; F02M 55/007; F02M 63/0017; F02M 2200/04;
(Continued)

(56) References Cited

U.S. PATENT DOCUMENTS 4,625,919 A * 12/1986 Soma ..... F02M 51/06 239/585.4
5,044,562 A * 9/1991 Rogers ..... F02M 61/1853 239/543

(Continued)

FOREIGN PATENT DOCUMENTS

FR 3024499 A1 2/2016
WO 2015106866 A1 7/2015
WO WO-2015106866 A1 * 7/2015 ..... F02M 55/002

*Primary Examiner* — David Hamaoui
*Assistant Examiner* — John D Bailey
(74) *Attorney, Agent, or Firm* — Joshua M. Haines

(57) ABSTRACT

A coil assembly in a fuel injector includes a magnetic core and; a winding wound around the core, the winding being overmoulded and forming a cylindrical overmoulding. An axial blind hole extends towards the interior of the coil assembly from a first surface to a distal end, the blind hole being suitable for housing at least one spring for loading a magnetic armature. The coil assembly is provided with a degassing hole passing through the core and the overmoulding from the blind axial hole to an axial outer cylindrical surface, the degassing hole being provided in the magnetic core and having a restriction that is arranged in a first section that is proximal to the blind axial hole.

14 Claims, 3 Drawing Sheets

(52) U.S. Cl.
CPC ..... *F02M 63/0017* (2013.01); *F02M 2200/04* (2013.01); *F02M 2200/28* (2013.01); *F02M 2200/31* (2013.01); *F02M 2200/50* (2013.01); *F02M 2200/80* (2013.01)

(58) Field of Classification Search
CPC ..... F02M 2200/28; F02M 2200/31; F02M 2200/50; F02M 2200/80
USPC ..... 123/445
See application file for complete search history.

(56) References Cited

U.S. PATENT DOCUMENTS 5,295,627 A * 3/1994 Wahba ..... F02M 51/061 239/585.1
5,664,545 A * 9/1997 Kato ..... F02M 47/027 123/467
6,276,335 B1 * 8/2001 Egler ..... F02M 47/027 123/446
2006/0076438 A1 * 4/2006 Dallmeyer ..... F02M 61/165 239/585.1
2006/0157595 A1 * 7/2006 Peterson, Jr. ..... F02M 61/1853 239/533.12
2007/0215114 A1 * 9/2007 Akabane ..... F02M 61/1853 123/445
2007/0284455 A1 * 12/2007 Suzuki ..... F02M 47/027 239/96
2009/0107463 A1 * 4/2009 Serizawa ..... F02M 63/0024 123/476
2010/0301247 A1 * 12/2010 Reiter ..... F02M 61/12 251/129.15
2010/0313850 A1 * 12/2010 Kondo ..... F02M 63/023 123/445
2013/0270370 A1 10/2013 Kondo et al.
2015/0040848 A1 * 2/2015 McAlister ..... F02B 47/04 123/1 A
2015/0152823 A1 * 6/2015 Akazaki ..... G01L 9/00 123/445

* cited by examiner

COIL ASSEMBLY

CROSS REFERENCE TO RELATED APPLICATIONS

This application is a national stage application under 35 USC 371 of PCT Application No. PCT/EP2017/071046 having an international filing date of Aug. 21, 2017, which is designated in the United States and which claimed the benefit of FR Patent Application No. 1658148 filed on Sep. 1, 2016, the entire disclosures of each are hereby incorporated by reference in their entirety.

TECHNICAL FIELD

The present invention concerns a fuel injector and has a particular but not exclusive application to fuel injectors intended to deliver pressurized fuel to a combustion chamber of an internal combustion engine.

TECHNOLOGICAL BACKGROUND OF THE INVENTION

Fuel injection systems for modern internal combustion engines, in particular compression ignition engines, comprise a plurality of fuel injectors adapted to emit an atomized jet of fuel at high pressure into a combustion chamber of the engine.

A fuel injector known to be used in a system of the above kind. It comprises an injection needle. The needle slides inside the bore formed in a nozzle body and being able to cooperate with a seat to control the distribution of fuel through one or more outlet openings.

When at the start of injection an actuator is electrically energized to perform the opening action, which leads to the movement of an armature and a valve element, also known to professionals as a valve stem. The control stem is situated in the low-pressure chamber, the control stem then moves upward against the action of a coil spring of the actuator. At this stage the length of the spring is reduced and an oscillation propagates from turn to turn and then to the control stem and the oscillation therefore produces to and fro movements creating disturbances in the fuel flow. The propagation of the oscillation comes to disturb the movement of the armature fastened to the control stem member. There then arise oscillations in the forces applied to close or to open the control valve. This problem is explained by a disturbed movement of the armature caused by oscillations to which the spring is subjected. Moreover, this problem will be solved by the present invention, which is to be described later.

SUMMARY OF THE INVENTION

The present invention aims to solve the problem of movement of the armature caused by the oscillations to which the spring is subjected. The invention consists in a coil assembly of an electromagnetic actuator adapted to be used in a fuel injector. The coil assembly comprises a magnetic core extending along a principal axis, a winding wound around the core, the winding being overmolded to form a cylindrical overmolding and extending axially from a transverse first face to a second surface 48. The overmolded coil assembly further comprises an axial blind hole extending toward the interior of the coil assembly from the first surface at a distal end. The blind hole is adapted to house at least one spring in order to load a magnetic armature. The coil assembly is further provided with a degassing hole passing through the core and the overmolding from the axial blind hole to an axial cylindrical external surface. The degassing hole is formed in the magnetic core. The degassing hole has a restriction in a first section that is proximal to the axial blind hole. The first section has a first diameter D62 and a first length L62 with the following characteristics:

$1<L62/D62<8$, preferably 6.

The degassing hole has a second section with a second diameter D64 at a proximal end of a return circuit and a second length L64:

$-0.02<D62/D64<0.06$, preferably $D62/D64=0.04$ $-0.15\leq L62/L64<0.3$, preferably $L62/L64=0.15$.

The degassing hole is disposed proximally to the distal end of the axial blind hole.

The degassing hole is proximal to the first face of the winding.

Moreover a diameter D50b of the blind hole is less than a mean diameter D50a of the axial blind hole with which the first section of the calibrated degassing hole communicates.

The degassing hole is at an angle to the principal axis between 80 degrees and 120 degrees inclusive. The angle may be 90°.

Moreover an actuator of the fuel injector comprises the coil assembly as described above. Also a fuel injector comprises the actuator as described above.

A method of manufacturing a coil assembly as described above comprises the following steps:

- winding electric wire onto a subassembly, then;
- winding the wire at one end of the terminals, then;
- fitting caps to the lower end of the terminals and welding the caps, then;
- overmolding the coil assembly and thereafter;
- producing the first section of the degassing hole in the magnetic core, then;
- producing the second section of the degassing hole in the overmolding of the coil assembly.

The degassing hole may be produced using an attached part during the overmolding of the wire.

BRIEF DESCRIPTION OF THE DRAWINGS

Other features, aims and advantages of the invention will become apparent on reading the following detailed description with reference to the appended drawings provided by way of nonlimiting example.

DESCRIPTION OF PREFERRED EMBODIMENTS

Figure 1:
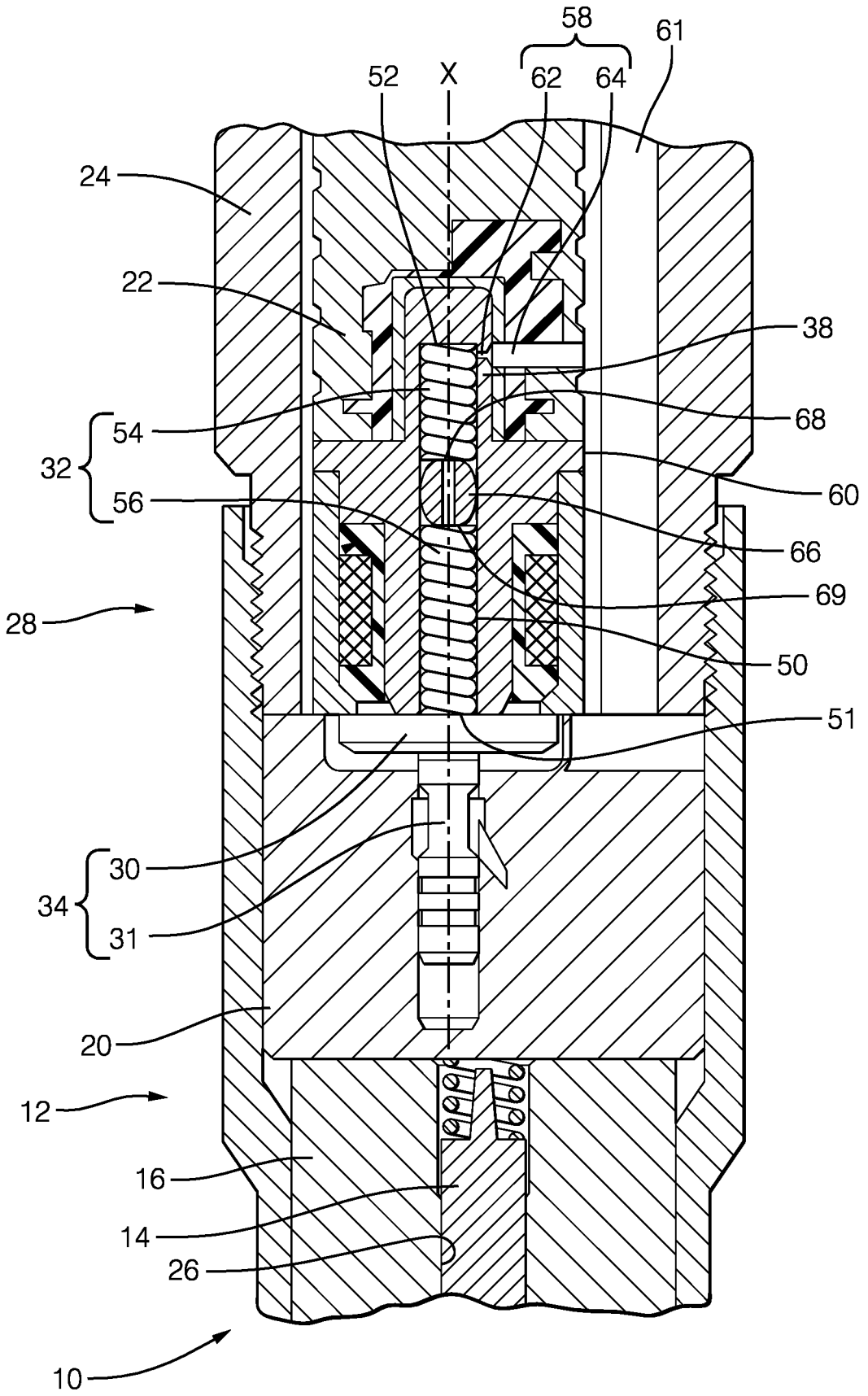
FIG. 1 is a partial section of an injector.

To facilitate and clarify the following description, the top to bottom orientation is chosen arbitrarily and words and expressions such as "hereinabove, below, above, below, top, bottom . . . " may be used without any intention of limiting the invention.

The injector 10 extends along a longitudinal axis X and comprises, from bottom to top in the conventional and nonlimiting direction of the figures, a nozzle assembly 12 comprising a valve element 14 or as it is commonly called a needle 14 arranged in a nozzle body 16, a control stem 34 arranged in a valve body 20, an actuator 22 arranged in an actuator body 24. The needle 14 is arranged to slide axially in a cylindrical longitudinal bore 26 in the nozzle body between a closed position in which the needle 14 is in contact with a nozzle body seat (not shown) and an open position in which the needle 14 is moved away from the seat (not shown).

As described in FIG. 1, the injector 10 is provided with a fuel circulation circuit that enables high-pressure fuel to be fed via a high-pressure circuit from an inlet orifice arranged in a top part of the injector 10 to the injection holes (not shown) arranged in a bottom part of the injector 10.

Figure 2:
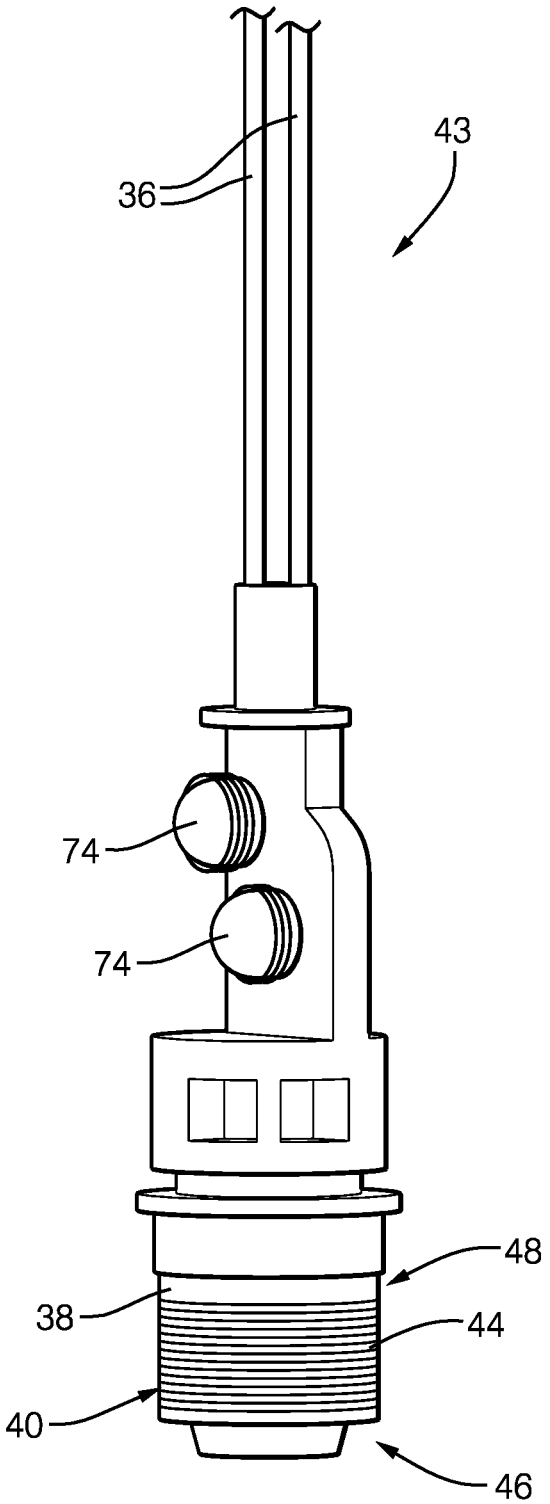
FIG. 2 is an isometric view of a coil subassembly.
Figure 3:
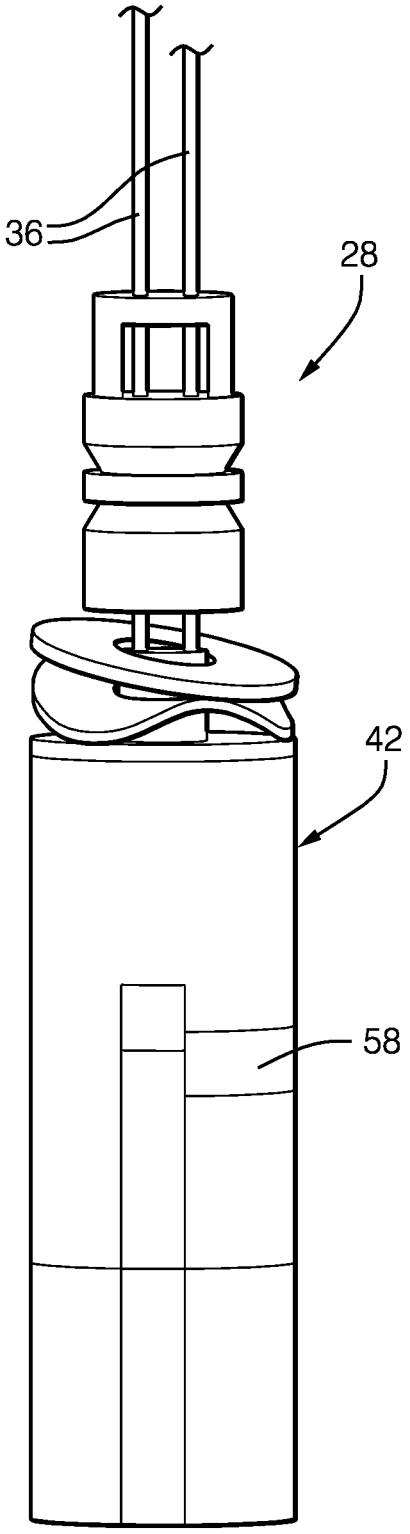
FIG. 3 is an isometric view of a coil assembly.
Figure 4:
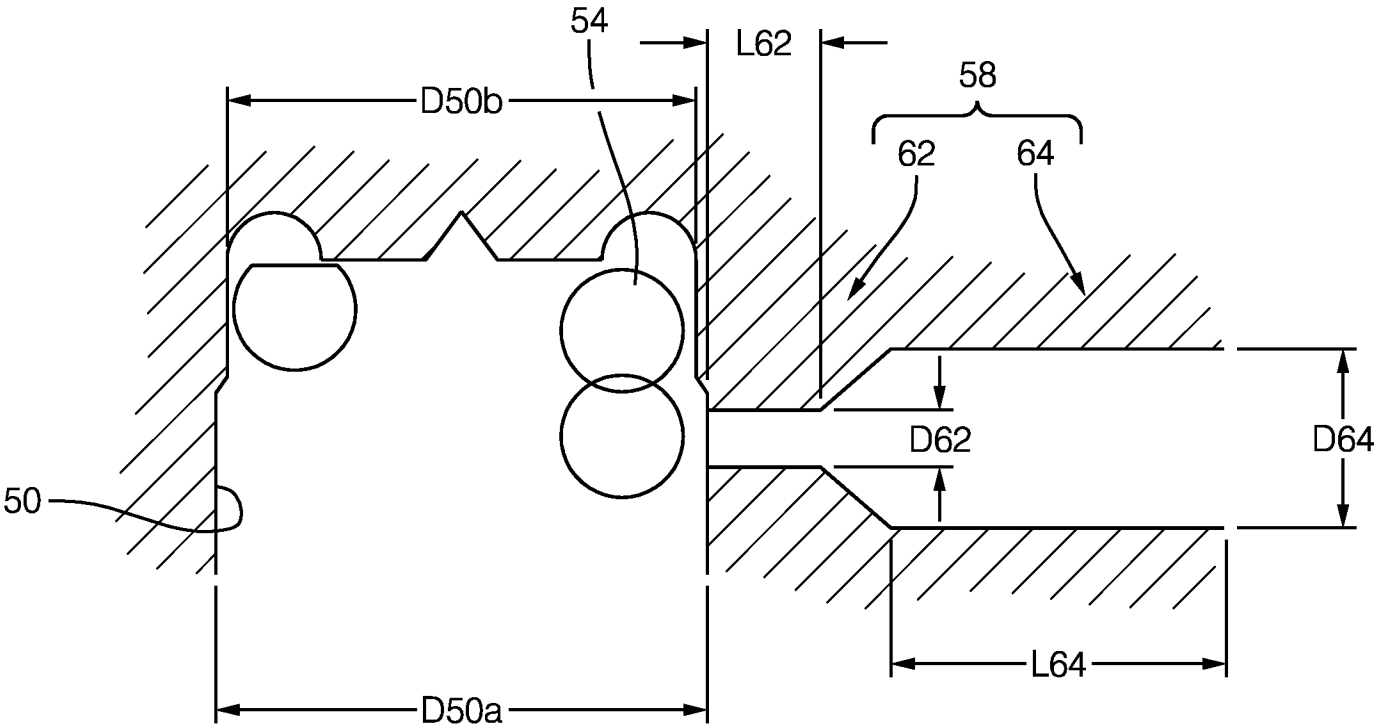
FIG. 4 is a section of the degassing hole.

A first embodiment is described now with reference to FIGS. 1, 2 and 3. The electromagnetic actuator 22 comprises an electric coil assembly 28, a mobile magnetic armature 30 fixed and fastened to a valve element 31 and commonly called a control stem 34 moving toward the coil assembly 28 when the latter is electrically energized and an elastic device 32 pushing the magnetic armature 30 at all times toward a position away from the coil assembly 28. The coil assembly 28 comprises a cylindrical overmolding 42 and a coil subassembly 43 comprising two ends 36, a core 38 and a winding 40 wound around the core 38. The two ends 36 extend along the principal X toward an upper end of the subassembly 43. The winding 40 is overmolded to form the cylindrical overmolding 42. The winding 40 extends axially from a transverse first face 46 extending axially as far as a second surface 48. The overmolded coil assembly 28 further comprises an axial blind hole 50 extending toward the interior of the coil assembly 28 from a first end 51 to a second end 52. The blind hole 50 is adapted to house at least two springs 54, 56 for loading the magnetic armature 30. The coil assembly 28 is further provided with a degassing hole 58 passing through the overmolding 42 from the axial blind hole 50 to an axial external cylindrical surface 60. The degassing hole 58 has a restriction arranged in a first section 62 that is proximal to the axial blind hole 50. The restriction is a reduction in the diameter of the hole such that, placed in the flow of the moving fluid, it limits its flow rate or modifies the pressure in the first portion 62 of the degassing hole. The restriction also produces necessary head losses of the pressurized fluid in a leak return circuit 61.

The degassing hole 58 has a first section 62 having a first diameter D62 and a first length L62 with the following characteristics:

$1<L62/D62<8$, preferably 6.

The choice of these dimensions enables complete reduction of the return waves of the fluid in the axial blind hole 50.

The degassing hole 58 has a second section 64 with a second diameter D64 between the first section 62 and the exterior transverse surface 60 proximal to the leak return circuit 61 and a second length L64:

$-0.02<D62/D64<0.06$, preferably $D62/D64=0.04$;

$-0.15\leq L62/L64<0.3$, preferably $L62/L64=0.15$.

Similarly the choice of the dimensions of the two sections 62, 64 enables less turbulent flow toward the leak return circuit 61.

The degassing hole 58 is disposed proximally to the distal second end 52. In other alternatives not shown the degassing hole 58 may be proximal to the first end 51 of the blind hole. The degassing hole 58 is at an angle of 90° to the principal axis X. In an alternative embodiment not shown the degassing hole 58 may be at an angle to the principal axis X between 80 degrees and 120 degrees inclusive.

The blind hole 50 extends along the longitudinal axis X. The blind hole 50 has a first diameter D50a and a second diameter D50b. The first diameter D50a is the mean diameter of the hole 50. The second diameter D50b is less than the mean or first diameter D50a of the hole.

The elastic device 32 comprises two coil springs 54, 56 separated by a separator member 66 or pin 66. In other alternatives of the elastic device 32 may comprise a single spring 54, 56. The elastic device 32 is arranged in the axial blind hole 50. In FIG. 1, the first spring 54 is compressed between the first face 68 of the pin 66 and the second end 52 of the hole. The second spring 56 is compressed between the second face 69 of the pin and the electric armature 30.

The method of manufacturing the coil assembly 28 comprises the following steps:

- winding electric wire 44 onto a subassembly 43, then;
- winding the wire 44 at one end of the terminals 36, then;
- fitting caps 74 to the lower end of the terminals 74 and welding the caps 74, then;
- overmolding the coil assembly 28 and thereafter;
- producing the first section 62 of the degassing hole 58 in the magnetic core 38, then;
- producing the second section 64 of the degassing hole in the overmolding 42 of the coil assembly 28.

The calibrated degassing hole 58 is therefore formed in the magnetic part 38. The degassing hole 58 may be produced by laser technology or by any other means. The shape of the degassing hole 58 may be round, square or conical or any other shape.

In this chapter we are going to describe the operation of the injector 10. As described in FIG. 1, when the actuator 22 is electrically energized the two springs 54, 56 of the actuator are compressed by the pressure with which they are loaded by the armature 30 and the pressure in the axial blind hole 50 increases. During the opening phase of the control stem 34, the length of the springs 54, 56 is reduced so that the volume of the axial hole 50 is reduced so that the pressure increases. The armature 30, moving upward, pushes on the fluid in the axial blind hole 50 and the wave created in the fluid moves downward toward the armature 30. The wave created in the fluid therefore disturbs the control stem 34. The raised pressure in the axial hole 50 is eliminated via the degassing hole 58 which is in fluid communication with the axial blind hole 50 via the first section 62 of the degassing hole and via the second section 64 arranged in line with the first section 62 between the first section 62 and a low-pressure zone that communicates with the leak return circuit 61.

The following references have been used in the description:

10 injector
12 nozzle assembly
14 needle
16 nozzle body
20 valve body
22 actuator
24 actuator body
26 blind hole
28 coil assembly
30 armature
31 valve element
32 elastic device
34 control stem
36 end
38 core
40 winding
42 overmolding
43 winding subassembly
44 winding wires
46 first winding surface

48 second winding surface
50 axial blind hole
51 first end
52 second end
54 first spring
56 second spring
58 degassing hole
60 transverse exterior surface
61 return circuit
62 first section
64 second section
66 separator member/pin
68 first pin face
69 second pin face
74 cap
X longitudinal axis

The invention claimed is:

1. A coil assembly of an electromagnetic actuator in a fuel injector, the coil assembly comprising:

a magnetic core extending along a principal axis;

a winding wound around the magnetic core, the winding being overmolded to form a cylindrical overmolding and extending axially from a transverse first face to a second surface;

an axial blind hole extending toward an interior of the coil assembly from the transverse first face at a distal end, the axial blind hole being adapted to house at least one spring which loads a magnetic armature; and a degassing hole passing through the magnetic core and the cylindrical overmolding from the axial blind hole to an axial external cylindrical surface, the degassing hole formed in the magnetic core and having a restriction in a first section that is proximal to the axial blind hole and in which the first section has a first diameter and a first length wherein the first length divided by the first diameter is greater than 1 and is less than 8.

2. The coil assembly as claimed in claim 1, wherein the first length divided by the first diameter is 6.

3. The coil assembly as claimed in claim 1, wherein:

the degassing hole has a second section with a second diameter at a proximal end of a return circuit and a second length;

the first diameter divided by the second diameter is greater than 0.02 and is less than 0.06; and the first length divided by the second length is greater than or equal to 0.15 and is less than 0.3.

4. The coil assembly as claimed in claim 3, wherein the first diameter divided by the second diameter is 0.04.

5. The coil assembly as claimed in claim 3, wherein the first length divided by the second length is 0.15.

6. The coil assembly as claimed in claim 1, wherein the degassing hole is disposed proximally to the distal end of the axial blind hole.

7. The coil assembly as claimed in claim 1, wherein a diameter of the axial blind hole is less than a mean diameter of the axial blind hole with which the first section of the degassing hole communicates.

8. The coil assembly as claimed in claim 1, wherein the degassing hole is at an angle to the principal axis between 80 degrees and 120 degrees inclusive.

9. The coil assembly as claimed in claim 8, wherein the angle is 90 degrees.

10. A fuel injector comprising:

a coil assembly comprising:

a magnetic core extending along a principal axis;

a winding wound around the magnetic core, the winding being overmolded to form a cylindrical overmolding and extending axially from a transverse first face to a second surface;

an axial blind hole extending toward an interior of the coil assembly from the transverse first surface at a distal end, the axial blind hole being adapted to house at least one spring which loads a magnetic armature; and a degassing hole passing through the magnetic core and the cylindrical overmolding from the axial blind hole to an axial external cylindrical surface, the degassing hole formed in the magnetic core and having a restriction in a first section that is proximal to the axial blind hole and in which the first section has a first diameter and a first length wherein the first length divided by the first diameter is greater than 1 and is less than 8.

11. A method of manufacturing the coil assembly as defined in claim 3, comprising the following steps:

winding electric wire onto a subassembly, then;

winding the electric wire at one end of terminals, then;

fitting caps to a lower end of the terminals and welding the caps, then;

overmolding the coil assembly and thereafter;

producing the first section of the degassing hole in the magnetic core, then;

producing the second section of the degassing hole in the overmolding of the coil assembly.

12. The method as defined in claim 11, in which the degassing hole is produced using an attached part during the overmolding of the electric wire.

13. The coil assembly as claimed in claim 1, wherein:

the degassing hole has a second section with a second diameter and a second length;

the first section is located between said axial blind hole and said second section; and the first diameter is smaller than the second diameter.

14. The fuel injector as claimed in claim 10, wherein:

the degassing hole has a second section with a second diameter and a second length;

the first section is located between said axial blind hole and said second section; and the first diameter is smaller than the second diameter.

* * * * *